US009981765B2

(12) United States Patent
Hyca

(10) Patent No.: US 9,981,765 B2
(45) Date of Patent: May 29, 2018

(54) DEVICE AND METHOD FOR LABELING INDIVIDUAL PACKAGES

(71) Applicant: ESPERA-WERKE GmbH, Duisburg (DE)

(72) Inventor: Bohumil Hyca, Stuttgart (DE)

(73) Assignee: ESPERA-WERKE GmbH, Duisburg (DE)

( * ) Notice: Subject to any disclaimer, the term of this patent is extended or adjusted under 35 U.S.C. 154(b) by 335 days.

(21) Appl. No.: 14/907,245

(22) PCT Filed: Jun. 13, 2014

(86) PCT No.: PCT/EP2014/062380

§ 371 (c)(1),
(2) Date: Jan. 22, 2016

(87) PCT Pub. No.: WO2015/014528

PCT Pub. Date: Feb. 5, 2015

(65) Prior Publication Data

US 2016/0159511 A1 Jun. 9, 2016

(30) Foreign Application Priority Data

Aug. 1, 2013 (DE) ..... 10 2013 012 726

(51) Int. Cl.
*B65C 1/02* (2006.01)
*B65C 9/18* (2006.01)
(Continued)

(52) U.S. Cl.
CPC ..... *B65C 1/021* (2013.01); *B65C 1/025* (2013.01); *B65C 9/02* (2013.01); *B65C 9/1803* (2013.01);
(Continued)

(58) Field of Classification Search
CPC ..... B65C 1/021; B65C 1/025; B65C 9/02; B65C 9/1803; B65C 9/1876; B65C 9/26; B65C 9/34
See application file for complete search history.

(56) References Cited

U.S. PATENT DOCUMENTS

2006/0027304 A1 2/2006 Fujita

FOREIGN PATENT DOCUMENTS

CN 1733556 A 2/2006
DE 102007034698 A1 1/2009
(Continued)

OTHER PUBLICATIONS

English translation of Written Opinion of WO2015/014528.*
(Continued)

*Primary Examiner* — Sonya Mazumdar
(74) *Attorney, Agent, or Firm* — Rankin, Hill & Clark LLP

(57) ABSTRACT

The invention relates to a device for labeling individual packages including a feed device for transporting a respective package in a transport direction, a printing device for printing a label, which can be removed from a material strip, wherein the printing device has a label dispensing unit for dispensing the printed label in a dispensing direction, and an application device for applying the printed label to the respective package. The application device has a manipulator for moving the printed label from a pick-up position, in which the printed label can be transferred from the label dispensing unit to the manipulator in the dispensing direction, to a dispensing position, in which the manipulator can apply the printed label to the package, via at least one transport position. The invention also pertains to a corresponding method for labelling individual packages.

28 Claims, 5 Drawing Sheets

Figure 1:
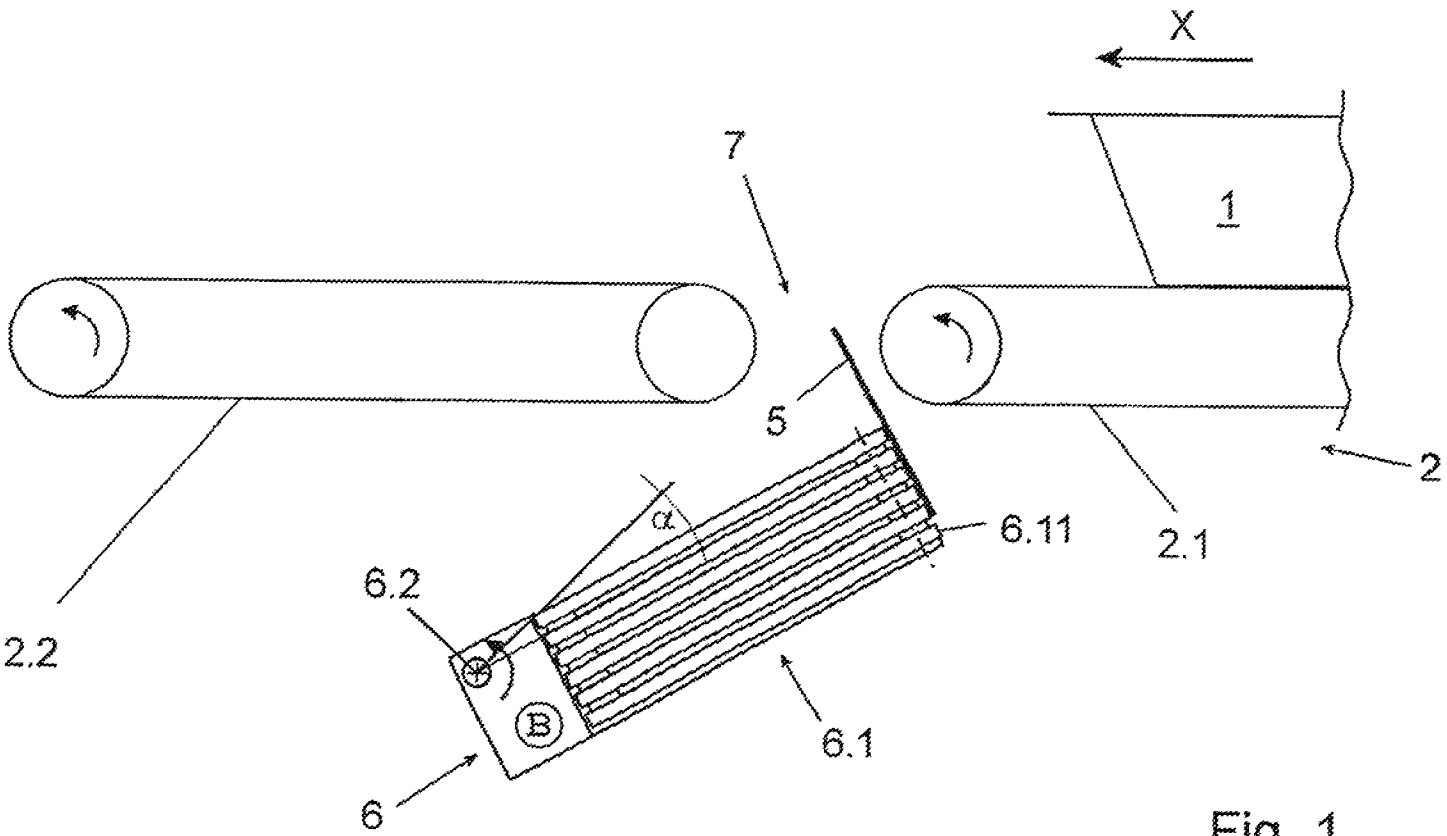

(51) Int. Cl.
*B65C 9/34* (2006.01)
*B65C 9/02* (2006.01)
*B65C 9/26* (2006.01)

(52) U.S. Cl.
CPC ..... *B65C 9/1876* (2013.01); *B65C 9/26* (2013.01); *B65C 9/34* (2013.01)

(56) References Cited

FOREIGN PATENT DOCUMENTS

| | | | |
|---|---|---|---|
| JP | H0486709 | U | 7/1992 |
| JP | H0654517 | U | 7/1994 |
| JP | 2002173119 | | 6/2002 |
| JP | 2003261120 | | 9/2003 |
| JP | 2004090927 | | 3/2004 |
| JP | 2005212823 | A | 8/2005 |
| JP | 2010023862 | A | 2/2010 |
| JP | 2013133129 | A | 7/2013 |

OTHER PUBLICATIONS

English translation of DE102007034698.*
English translation of claims for JPH04086709.*
English translation of JP2002173119.*
English translation of JP2003261120.*
English translation of JP2004090927.*
English translation of JP2005212823.*
English translation of JP2010023862.*
English translation of JP2013133129.*
English translation of JPH06054517.*

* cited by examiner

DEVICE AND METHOD FOR LABELING INDIVIDUAL PACKAGES

The invention relates to a device for labelling individual packages, comprising a feed device for transporting the respective package in a transport direction, comprising a printing device for printing a label, which can be removed from a material strip and which is in particular removably applied to a carrier strip, wherein the printing device has a label dispensing unit for dispensing the printed label in a dispensing direction, and comprising an application device for applying the printed label to the respective package, wherein the application device has a manipulator means for moving the printed label from a pick-up position, in which the printed label can be transferred from the label dispensing unit to the manipulator means in the dispensing direction, to a dispensing position, in which the manipulator device can apply the printed label to the package, via at least one transport position.

The invention further relates to a method for labelling individual packages, in which a package is transported in a transport direction, in which a label, which can be removed from a material strip and which is in particular removably applied to a carrier strip, is printed, in which the printed label is transferred to a manipulator means at a pick-up position, in which the manipulator means moves the label from the pick-up position in a dispensing position via at least one transport position, and in which manipulator means applies the label to the package at the dispensing position.

A device and a method of the afore-mentioned type are known from WO 2012/104251 A1. The labels are hereby removably applied to a material strip in the form of a carrier strip. The manipulator means has an axially displaceable transport carriage, which is provided with a telescopic arm, to the other end of which a suction foot is mounted. The unit of transport carriage, telescopic arm and suction foot can be pivoted about a horizontal axis, which runs at right angles to the transport direction of the packages and in a direction parallel to the plane, along which the package is transported. The unit of transport carriage, telescopic arm and suction foot can furthermore be moved along this axis. A printed label is transferred from a label dispensing unit to the manipulator means at a pick-up position, namely to the suction foot, which suctions the label by means of a under-pressure. The telescopic arm, which is arranged between suction foot and transport carriage, is retracted subsequently, the unit of transport carriage, telescopic arm ad suction foot comprising the label adhering thereto is moved along the axis and is pivoted about the axis and the label is subsequently transferred to the package by the suction foot. The manipulator means subsequently moves back into the pick-up position and suctions a new label.

The disadvantage of this prior art is the relatively large time period between the application of a label and the application of the next label. As a result, the cycling of the feed device, thus the transport of the packages, must take place correspondingly slowly.

It is an object of the present invention to create a device and a method for labelling individual packages, by means of which the labeling process is accelerated.

The above-derived and specified object is solved according to a first teaching of the present invention in the case of a device for labeling individual packages comprising a feed device for transporting the respective package in a transport direction, in particular a horizontal transport direction, comprising a printing device for printing a label, which can be removed from a material strip and which is in particular removably applied to a carrier strip, wherein the printing device has a label dispensing unit for dispensing the printed label in a dispensing direction, in particular comprising at least one direction component opposite the transport direction of the respective package and, in the alternative, comprising at least one direction component in transport direction of the respective package, and comprising an application device for applying the printed label to the respective package, wherein the application device has a manipulator means for moving the printed label from a pick-up position, in which the printed label can be transferred from the label dispensing unit to the manipulator means in the dispensing direction, to a dispensing position, in which the manipulator means can apply the printed label to the package, via at least one transport position, in that the manipulator means has an element, which can carry out a circulating movement, that is, not a back and forth movement, along a circulating path, wherein the element has at least a first section for picking up (that is, for carrying), a printed label and at least a second section for picking up (that is, for carrying) a printed label, wherein the first section and the second section are arranged on the circulating path of the element. That is, the first and second section are arranged in such a manner that, in response to a circulating movement of the element, they can consecutively pass the location inside the device, which is defined as pick-up position, and/or in such a manner that, in response to a circulating movement of the element, they can consecutively pass the location inside the device, which is defined as dispensing position. In an embodiment, which will be explained below, provision can even be made for the first and second section to be able to first pass through the pick-up position and then the dispensing position consecutively during a circulating movement.

A label, which can be removed from a material strip, refers to a label, which can be formed in a number of ways. For example, the label is a printable sheet or paper, respectively, which is removably applied to a carrier strip, which forms the material strip in this case and which can consist of paper or plastic; in this case, the label is removed from the carrier strip or material strip, respectively, and is transferred to the manipulator means during or after the removal. However, the label can also be a partial section of a printable material strip, for example paper strip, which has been removed from the other material strip by being severed. The severing can take place by cutting off or tearing off; in this case, the label is removed or severed, respectively, from the material strip and is transferred to the manipulator means during or after the removal or severing, respectively.

The transport positions define locations inside the device, through which the respective section of the element or the label arranged thereon, respectively, or connected thereto, respectively, pass, when the section or the label, respectively, is moved (transported) from the pick-up position to the dispensing position; these are thus intermediate positions on the way between pick-up position and dispensing position. Every transport or intermediate position, respectively, is defined in particular in that the application device, in particular the manipulator means and the element is stopped (does not move) and/or the direction of movement changes during the operation of the device. All of the positions defined above, that is, the pick-up position, the dispensing position and the at least one transport position or the plurality of transport positions, respectively, are arranged at different locations inside the device (or relative to the stationary components of the device, such as the feed device, respectively), wherein these locations or positions, respectively, do not overlap with one another in the direction of movement of the circulating path.

As a result of the setup according to the invention, as will be explained in more detail below, two labels can be arranged simultaneously on the manipulator means and can be manipulated as intended. While a first label is connected to a section of the element, a second label is thus capable of/can be connected to the other section of the element (arranged thereon) and/or a label, which has already been arranged on a different section of the element beforehand, can be applied to the package while a second label is connected to a section of the element. The labeling process can thus be shortened significantly as compared to the prior art.

As stated, the first section and the second section can be brought into the pick-up position and into each transport position as well as into the dispensing position by moving the element and/or the manipulator means. Not each of these positions must thereby be arranged or be located, respectively, on the same circulating path of the element, which carries out the circulating movement, but it is also possible for the pick-up position and the dispensing position to be arranged or located, respectively, on a first circulating path and for a first transport position and a second transport position to be arranged and/or located, respectively, on a second circulating path of the element. In the alternative, it is also possible for the pick-up position and the dispensing position to be arranged or located, respectively, on different circulating paths of the element, wherein provision is then made in particular for the pick-up position and a second transport position to be arranged or located, respectively, on a first circulating path and for a first transport position and the dispensing position to be arranged or located, respectively, on a second circulating path. "First" or "second" transport position, respectively, means that the label, which is transferred to the element in the pick-up position, first passes through the first transport position, before it subsequently reaches the second transport position.

So that the element can be moved on different circulating paths, provision is made in particular for the manipulator means to be pivotable about an axis between a first position and a second position. In the first position of the manipulator means, the element, which performs the circulating movement, has a first circulating path, in the second position it has a second circulating path. This makes it possible to bring a label into the pick-up position, which is located on the same circulating path as the dispensing position, to then pivot the manipulator means into the second position, in the first position of the manipulator means, whereby the label is then located in a first transport position on a second circulating path of the same element. By moving the element in the second position, in particular when carrying out a clocked movement, the label can be moved from the first transport position to the second transport position, which is located on the same circulating path as the first transport position. If the manipulator means is then pivoted back into the first position again, the label is moved into the dispensing position, which is then located on the first circulating path again, on which the pick-up position is located as well. In the alternative, it is also possible for the label to be brought into the pick-up position, which is located on the same circulating path as the second transport position in the first position of the manipulator means. However, before the label is moved to the second transport position, the manipulator means is pivoted from the first position into the second position, whereby the label reaches the first transport position, which is located on the same circulating path as the dispensing position. If the manipulator means is now pivoted back into the first position and if the element simultaneously carries out a circulating movement, in particular a stroke (interval), the label reaches the second transport position, which is again located on the first circulating path, on which the pick-up position is located as well. If the manipulator means is then pivoted back into the second position again, the label thus reaches the dispensing position, which is located on the same circulating path as the first transport position.

It is important to note that only the transport path of an individual label has been described above (in an exemplary manner). However, as soon as this label is located at certain positions, a further label can already be connected to (can be arranged on) the manipulator means or to the element, respectively. In the case of the first alternative, in which pick-up position and dispensing position are located on the same circulating path of the element, a different label can already be connected to the same element in the pick-up position, for example when a label is in the dispensing position; in this case, when a label is located in a transport position, a further label can also be located in a further transport position, which is spaced apart therefrom, wherein both labels are arranged on the same element. In the case of the other alternative, in which pick-up position and dispensing position are located on different circulating paths, a further label can be connected to the same element in a transport position, when a label is connected to the element in the pick-up position; in this case, when a label is in the dispensing position, a different label can also be connected to the same element in a different transport position.

In an embodiment of the device according to the invention, provision can be made for the element, in the first position of the manipulator means, to lead past the label dispensing unit and past the feed device relative to the feed device and printing device in such a manner that, at the pick-up position, a printed label can be transferred from the label dispensing unit to the element in the dispensing direction and that a label, which was transferred to the element, can simultaneously be applied to the package at the dispensing position. In this first position of the manipulator means, the element of the manipulator means (hereinafter referred to in short as "element"), which can carry out the circulating movement, thus protrudes so closely to the label dispensing unit as well as to the feed device that a printed label can be transferred from the label dispensing unit to the element and that a label can be applied to the package.

This embodiment is characterized in that, at the same time, in which a printed label is applied to the package, for example the bottom side of the package, a further label is simultaneously already transferred to the manipulator means or the element, respectively, which transports the label. As soon as the first label is applied to the respective package, the further label can immediately be moved to the dispensing position, where it can be applied to the next package. As compared to the prior art, the time period, which the manipulator means required in the prior art for moving from the dispensing position back into the pick-up position again, can thus be eliminated. According to the invention, the labelling process can thus take place within a significantly shorter time period, so that the cycling of the feed device, which transports the individual packages, can also be increased as compared to the prior art.

According to a design of the preceding embodiment of the device according to the invention, the manipulator means is oriented to the feed device in such a manner in the first position that, at the dispensing position, the label can protrude into an area, through which the package passes during the transport. In other words, the package is moved in the transport direction, wherein the transport path of the package crosses the area, in which the label is located at the dispensing position. With a side, which has an adhesive, the label then touches the package, in particular the bottom side of the package, wherein the package entrains the label and thus removes it from the element of the manipulator means.

According to an alternative embodiment of the device according to the invention, provision can be made for the element, in the first position of the manipulator means, to lead past the label dispensing unit and past the feed device relative to the feed device and printing device in such a manner that, in the dispensing direction, a printed label can be transferred from the dispensing unit can to the element in the dispensing direction and that, simultaneously, a label, which has been transferred to the element, can be connected to (arranged on) the element at one of the transport positions. It is possible thereby that, in the second position, the manipulation means is oriented in such a manner to the feed device that, at the dispensing position, the label can protrude into an area, through which the package passes during the transport.

The latter, second embodiment of the device according to the invention is also based on the principle according to the invention that two labels can simultaneously be arranged on the same element and can be manipulated as intended by means of the manipulator means, that is, they can be picked up subsequently by the element, transported (wherein, if applicable, a pivoting between a first and a second position of the manipulator means can also be carried out) and can be dispensed by the element (and applied to the package).

According to a further design of the device according to the invention, the manipulator means is configured in such a manner that the label, that is, the printed label, which is dispensed by the label dispensing unit, can adhere to the element. Compared to other methods for connecting the label to a manipulator means, an adhesion of the labels can be dissolved in a particularly simple manner. The manipulator means can thus have a means for generating a underpressure or a means for generating an electrostatic charge, for example. In particular, the manipulator means is configured in such a manner in this case that the means for generating a underpressure or the means for generating an electrostatic charge, respectively, can be turned on and off and/or the power (this refers to the power, which is output), can be adapted, that is, can reach any intermediate value between full power and a power of zero; in particular, the means can be turned off or can be operated with a reduced power in the pick-up position and/or in the dispensing position. In the pick-up position, this can be desired so as to temporarily reduce the force, with which the label adheres to the element of the manipulator means or with which the label is pulled by the element, respectively, if required to zero, so as to thus optimize the transfer of the label to the element or manipulator means, respectively. Otherwise, that is, at full power of the means for generating a underpressure or the electrostatic charge or at maximum power of attraction or adhesion, respectively, it could happen that the label does not optimally bear on the element of the manipulator means or is oriented. Accordingly, a turn-off or power reduction of the respective means can also be desired in the dispensing position, so as to temporarily reduce the power, which the label adheres to the element of the manipulator means or with which the label is pulled by the element, respectively, if necessary to zero, so as to thus optimize the application of the label to the package, which is to be labelled, preferably when the label already partially adheres to the package, which is to be labeled.

According to a further design of the device according to the invention, the element, which can carry out the circulating movement, is an endless belt. This endless belt can be designed in various ways. In particular, the endless belt can be configured in such a manner that it can be charged electrostatically, in particular with the means for generating an electrostatic charge. The endless belt for generating the underpressure can also be designed in a particular manner, as it will be described below.

So that the label can adhere to the endless belt by means of a underpressure, the endless belt can consist of at least two parallel aprons or apron sections, preferably of at least three parallel aprons or apron sections, particularly preferably of at least five parallel aprons or apron sections, which are in particular spaced apart from one another (an apron section refers to a section of an endless belt, in which the endless belt has a plurality of parallel aprons at least in a section). In the alternative or additionally, the endless belt can be perforated, in particular perforated several times, or slotted, in particular slotted several times. The manipulator means can have a plate, which is perforated, in particular perforated several times, or slotted, in particular slotted several times, which extends at least from the pick-up position, at which the respective label is transferred to the manipulator means, to the dispensing position, at which the respective label can be applied to the package, or to a transport position, which is located in the same vertical plane as the dispensing position, wherein the endless belt rests against the plate at least in a section. Air, which is accordingly also sucked through the space or the spaces, respectively, between the parallel aprons/apron sections and/or through the perforated or slotted endless belt, can be taken in through the bore or bores, respectively, or through the slot or the slots, respectively, in the plate. A underpressure, which accomplishes the adhesion of the label, is thus generated on the outer side (upper side) of the endless belt, with which the labels come into contact. Preferably, the perforated or slotted areas of the plate thereby overlap with the perforated or slotted areas of the endless belt or the spaces between the parallel aprons/apron sections. In other words, the holes (bores) or slots, respectively, in the plate end at least partially in the space or the spaces, respectively, between the parallel aprons/apron sections or are covered by the perforated or slotted area of the endless belt, respectively.

According to a yet further design of the device according to the invention, provision is made for the feed device to have two conveyor belts, in particular one of which or both of which is/are designed as knife edge conveyor, which can be moved in the transport direction and which are arranged to one another such that the respective package can reach from the one conveyor belt to the other conveyor belt, wherein the conveyor belts are arranged so as to be aligned with one another in particular in the transport direction, wherein provision is made between the conveyor belts for a gap, which runs at right angles to the transport direction and through which the manipulator means can apply the printed label to the package. The manipulator means is thereby preferably arranged vertically below the feed device or one of the conveyor belts, respectively, whereby, in the dispensing position, the respective label is guided through the gap from bottom to top, which is embodied between the conveyor belts. If a package is located vertically above the gap, the bottom side of the package comes into contact with the label and entrains the latter in response to further transporting the package.

According to yet a further design of the device according to the invention, provision is made for the element or the endless belt, respectively, and/or the plate to have a straight course and to in particular run at right angles to the transport direction in the area between the pick-up position and the dispensing position or in the area between the pick-up position and the transport position, which is located in the same vertical plane as the dispensing position. The label can be transported on the shortest path via a straight course, in particular when the printing device and/or label dispensing unit is located to the side of the feed device, in particular in the plane, in which the upper side of the conveyor belt, which follows after the gap in transport direction (transport plane) is located. On principle, however, it is also possible for the printing device and/or label dispensing unit to be arranged vertically below the feed device. In this case, the element and/or the plate of the manipulator means can also have a curved section, which is located between the pick-up position and the dispensing position.

According to a further design, the element of the endless belt, respectively, and/or the plate runs in a direction parallel to the gap, which is provided between the conveyor belts, in the area between the pick-up position and the dispensing position or in the area between the pick-up position and the transport position, which is located in the same vertical plane as the dispensing position. This is also the simplest and most direct solution for the case that the printing device or the label dispensing unit, respectively, is arranged on the side next to the feed device (in particular in the plane, in which the upper side of the conveyor belt, which follows after the gap in transport direction), is arranged.

According to yet a further design, the manipulator means can be pivoted about an axis between the first position, in which the label can be transferred from the label dispensing unit to the element or endless belt, respectively, and a second position, as already stated. The endless belt can thereby in particular be pivoted between this first position and the second position. If a plate is present, in particular the totality of endless belt and plate can be pivoted between the first and the second position. The axis thereby preferably runs at right angles to the transport direction and in a direction parallel to the plane, along which the package is transported. The pivotability allows for a pitching movement of the manipulator means, by means of which an unintentional contact of the label with a package, which is located vertically above the gap between the conveyor belts or the feed device can be avoided in response to moving the label along the gap or at right angles to the transport direction, respectively. In the pick-up position, the label can thus be transferred from the label dispensing unit to the element or endless belt, respectively, whereupon the manipulator means can be brought into the second position. In the case of the first alternative embodiment of the device according to the invention, the element or endless belt, respectively, and/or the plate of the manipulator means, in this second position, has in particular a larger distance from the feed device, in particular from the gap, than in the first position. In the case of the second alternative embodiment of the device according to the invention, the element or endless belt, respectively, and/or the plate of the manipulator means, in the first position, in particular has a larger distance from the feed device, in particular from the gap, than in the second position. If the element or endless belt, respectively, is then actuated in the position comprising the largest possible vertical distance to the feed device (in the first case thus in the second position, in the second case in the first position), the label can be moved into a position, which is located below a package, which is to be labeled. If the manipulator means is then pivoted back into the position, which has the smallest possible vertical distance to the feed device (in the first case thus into the first position, in the second case into the second position), the label only comes into contact with the package, in particular the bottom side of the package, and adheres thereto, only if the package is arranged vertically above the gap. On principle, however, it would also be possible that no package is yet located vertically above the gap between the conveyor belts at the point in time, at which the manipulator means is moved from the position, which has the largest possible vertical distance to the feed device, back into the position, which has the smallest possible vertical distance to the feed device, so that the label initially protrudes upwards through the gap, without coming into contact with a package. If the package is moved beyond the gap, it only comes into contact with the label at that point and the label adheres to the package.

The pivot angle between the first position and the second position can be between 5 and 60°, preferably between 30 and 45°, particularly preferably between 35 and 40°.

Such a small pivot angle allows to minimize the time period, which passes as a result of the pitching movement of the manipulator means, so that the labelling of the package can be carried out at a high speed in spite of the pitching movement.

According to a further design, in the case of the above-defined first embodiment of the device according to the invention, as stated, a printed label, which has been transferred to the element or endless belt, respectively, can be moved in particular at right angles to the transport direction and in a direction parallel to the plane, along which the package is transported, without thereby protruding into the area, through which the package passes in response to the transport in the second position. In the case of the mentioned alternative second embodiment, a printed label, which is transferred to the element, can be moved in particular at right angles to the transport direction and in a direction parallel to the plane, along which the package is transported, without thereby protruding into the area, through which the package passes in response to the transport, in the first position and/or between the first and second position. As stated, this allows for a transport of the label from the pick-up position to the dispensing position, without said label being able to unintentionally come into contact with a package or a part of the feed device.

According to yet a further design of the device according to the invention, provision is made, in turn, for the surface of the element, to which the label can adhere, to run at an angle, in particular at an angle β of between 20 and 80°, preferably between 30 and 65°, particularly preferably between 35 and 45°, to the plane, along which the package is transported, in the first position of the manipulator means. Such a flat angle ensures that the package, as soon as the label comes into partial contact with it, entrains the entire label and subsequently leads to an adhesion of the label to the package, in particular the bottom side of the package.

According to a further design of the device according to the invention, the dispensing direction, thus the direction, in which the label is transferred from the label dispensing unit to the element or endless belt, respectively, runs parallel to the surface of the element or endless belt, respectively, in the first position. The label can thus adhere to the element in a particularly simple manner, in particular by means of a underpressure or electrostatic charge.

According to yet a further design, the element or endless belt, respectively, is connected to a clocked drive, which effects the circulating movement of the element, wherein the stroke length (interval length) of the movement corresponds to the horizontal distance between the pick-up position and the dispensing position. The horizontal distance refers to the distance in the direction, which runs parallel to the plane, in which the respective package, which is to be labelled, is transported. This thus does not refer to the length of the path, which the label passes from the pick-up position to the dispensing position, but the (straight) horizontal distance between pick-up position and dispensing position. A clocked drive has the advantage that the transfer of the label from the label dispensing unit to the element or endless belt, respectively, can take place when the element or endless belt, respectively, stands still, whereby the label remains oriented in a highly accurate manner. The label is then transported back into position, which has the result that, after pivoting back into the position, which has the smallest possible vertical distance from the feed device, the label comes into contact with the package, only then and in particular also only after the pivot movement into the position of the manipulator means, which has the largest possible vertical distance from the feed device.

According to yet a further design in the case of the alternative first embodiment, the device can have a control device, which is configured in such a manner that it can control the pivot movement of the manipulator means and the circulating (in particular clocked) movement of the element or endless belt, respectively, in such a manner that the circulating movement of the element is stopped when the label is transferred from the label dispensing unit transfers the label to the element, the manipulator means is pivoted from the first position into the second position after the label has been transferred to the element, in the second position of the manipulator means, the circulating movement of the element is carried out for the length of a stroke (interval), wherein the stroke length (interval length) of the movement corresponds to the horizontal distance between pick-up position and dispensing position, and the manipulator means is pivoted from the second position into the first position after the circulating movement has been stopped after carrying out the stroke (interval).

According to a further design in the case of the alternative second embodiment, the device can furthermore have a control device, which is configured in such a manner that it can control the pivot movement of the manipulator means and the circulating movement of the element in such a manner that the circulating movement of the element is stopped when the label dispensing unit transfers the label to the element, the manipulator means is pivoted from the first position into the second position after the label has been transferred to the element, the manipulator means is pivoted back into the first position after the second position has been reached, wherein, prior to, during and/or after pivoting the manipulator means from the second position back into the first position, the circulating movement of the element is carried out for the length of a stroke (interval), wherein the stroke length (interval length) of the movement corresponds to the horizontal distance between pick-up position and dispensing position.

Finally, the object is solved according to a second teaching of the present invention in the case of a method for labelling individual packages, in particular using the above-described device, in which a package is transported in a transport direction, in which a label, which can be removed from a material strip and which is in particular removably applied to a carrier strip, is printed, in which the printed label is transferred to a manipulator means at a pick-up position, in which the manipulator means moves the label from the pick-up position into a dispensing position via at least one transport position (intermediate position) and in which the manipulator means applies the label to the package at the dispensing position, in that, at the dispensing position, the manipulator means applies the label to the package, while, in the pick-up position or in one of the transport positions, a further printed label is simultaneously arranged on the manipulator means, in particular adheres thereto.

According to a design of the method according to the invention, in particular in the case that the device is embodied according to the above-defined alternative first embodiment, provision is made for the manipulator means to be pivoted from a first position into a second position after the respective label has been transferred to the manipulator means at the pick-up position, the label is then moved across a distance, which corresponds to the horizontal distance between the pick-up position and the dispensing position, the manipulator means is then pivoted from the second position back into the first position and the label is then applied to the package.

According to an alternative design of the method according to the invention, in particular in the case that the device is embodied according to the above-defined alternative second embodiment, provision is made for the manipulator means to be pivoted from a first position into a second position after the respective label has been transferred to the manipulator means at the pick-up position, the label is then moved across a distance, which corresponds to the horizontal distance between the pick-up position and the dispensing position, wherein the movement of the label is carried out prior to, during and/or after pivoting the manipulator means from the second position back into the first position, the manipulator means is then pivoted from the first position into the second position, and the label is then applied to the package, wherein provision is made in particular for a further label to be transferred to the manipulator means at the pick-up position after the manipulator means has been pivoted from the second position back into the first position.

Figure 2A:
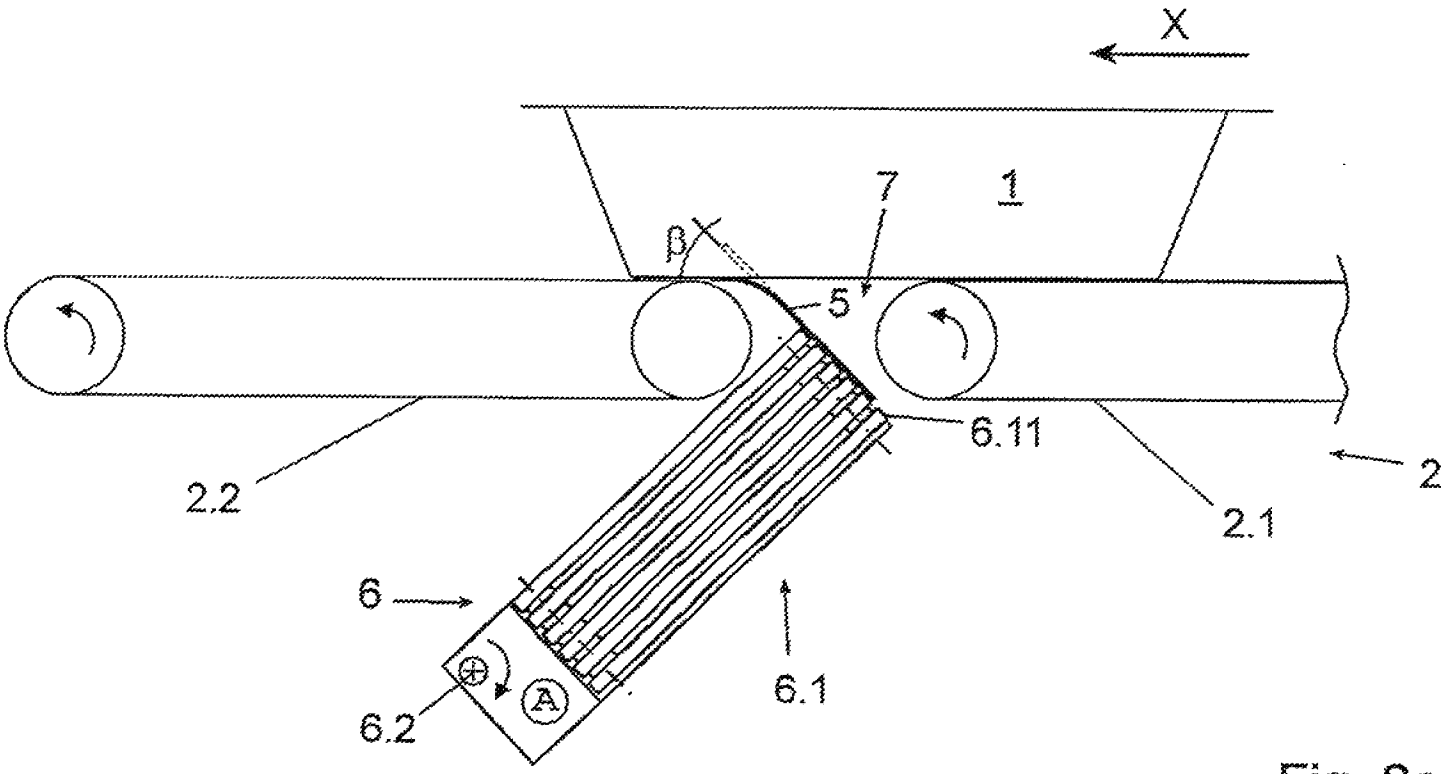
Figure 2B:
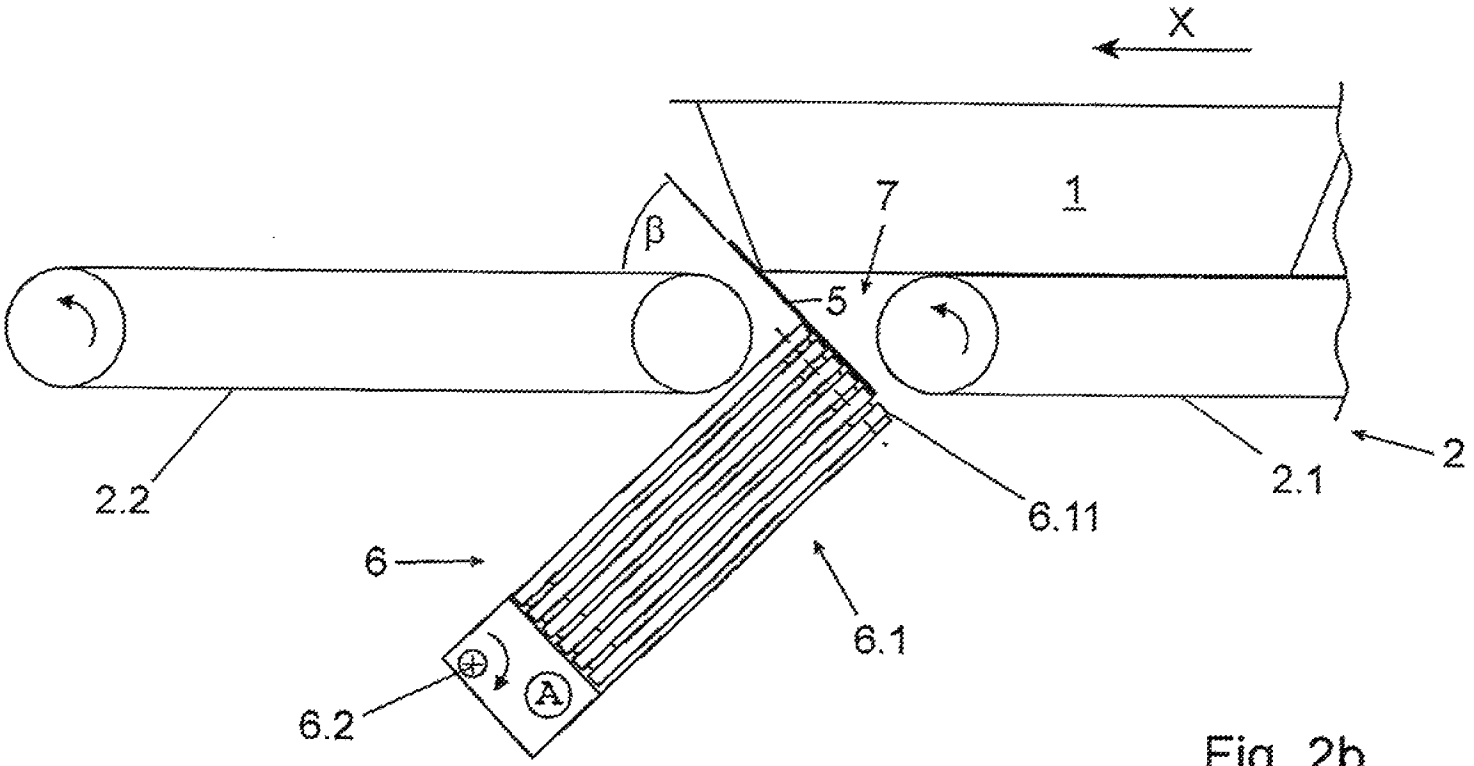
Figure 4:
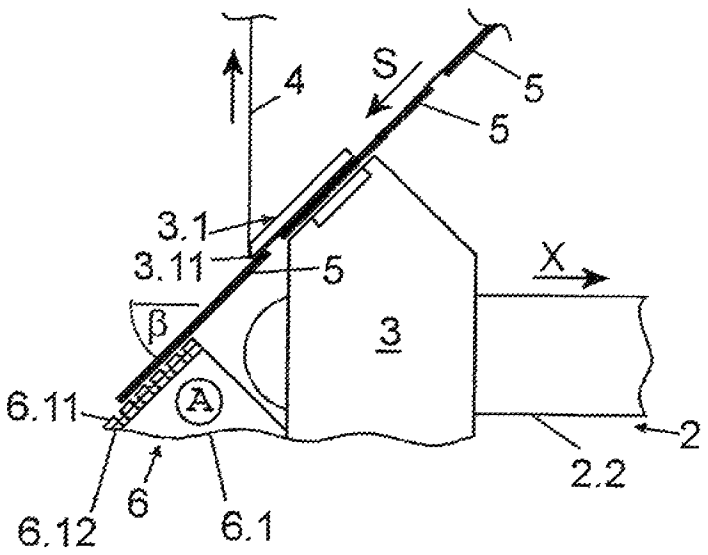
Figure 3:
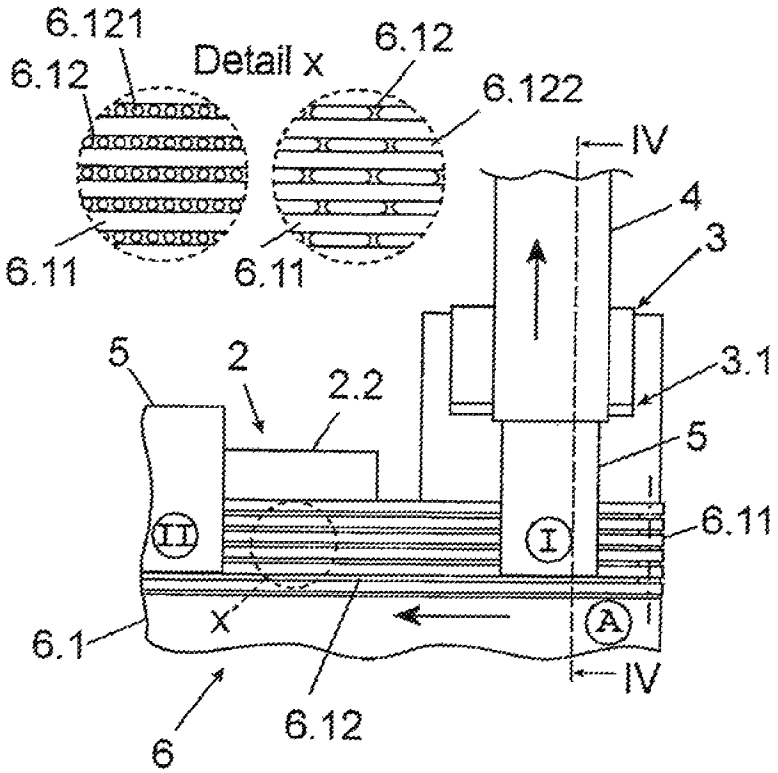
Figure 5B:
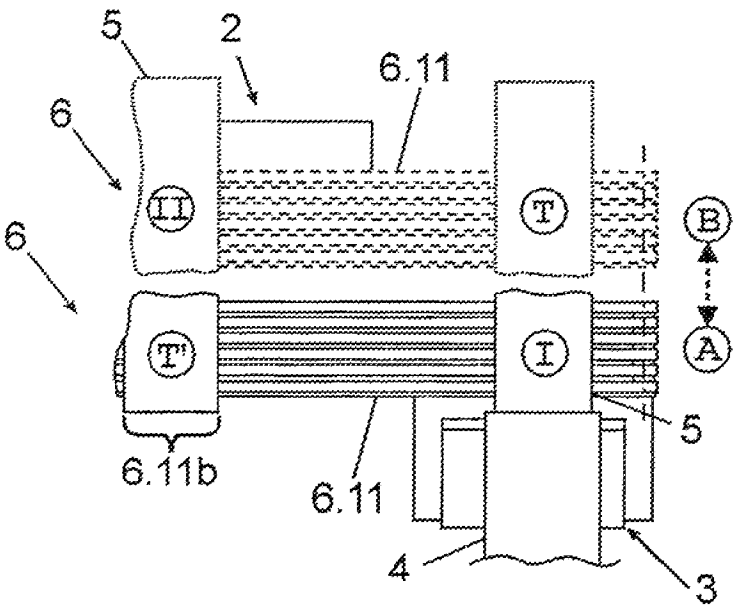
Figure 5A:
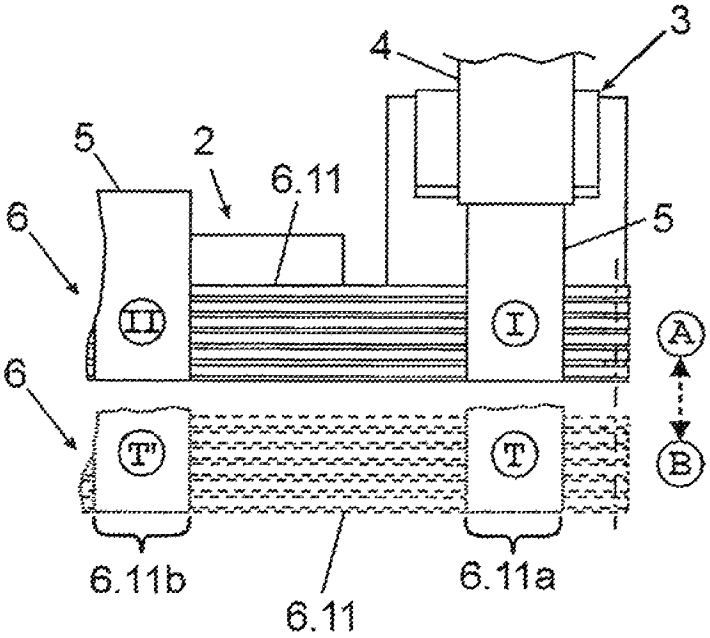

There is now a number of options for designing and further developing the device according to the invention and the method according to the invention. With regard to this, reference is made on the one hand to the claims, which follow claim 1, and, on the other hand, to the description of exemplary embodiments in combination with the drawing. In the drawing:

FIG. 1 shows a side view of a first alternative embodiment of the device according to the invention, wherein the manipulator means is in the second position, FIG. 2*a*) shows a side view of the device from FIG. 1, wherein the manipulator means is in the first position and a package, which is to be labeled, is located above a gap between two conveyor belts, FIG. 2*b*) shows a side view of the device from FIG. 1, wherein the manipulator means is in the first position and the package, which is to be labelled, has not yet crossed the gap between the conveyor belts completely, FIG. 3 shows a view of a part of the device according to the invention from FIG. 1, wherein the viewing direction coincides with the transport direction, FIG. 4 shows a sectional view along the sectional line IV-IV in FIG. 3, FIG. 5*a*) shows a view, which corresponds to FIG. 3, of a part of the first alternative embodiment of the device according to the invention, wherein the viewing direction coincides with the transport direction, and FIG. 5*b*) shows a view of a part of a second alternative embodiment of the device according to the invention, wherein the viewing direction coincides with the transport direction, and FIGS. 1 to 5*a*) show a first alternative embodiment of a device according to the invention. FIG. 5*b*) shows a second alternative embodiment of the device according to the invention, which differs therefrom. The two embodiments differ in the direction, in which a label 5 is dispensed after printing (dispensing direction S). In the case of the first embodiment, the printed label 5 is dispensed partially vertically from top to bottom, whereas, in the second embodiment, the printed label 5 is dispensed partially vertically from bottom to top; in the case of the first embodiment (FIGS. 1 to 5*a*)), the position "A", which will be explained in more detail below, is accordingly defined vertically above the position "B", which will be explained in more detail below, whereas, in the case of the second embodiment (FIG. 5*b*)), the position identified with "A" is defined vertically below the position identified with "B".

FIG. 1 shows a first embodiment of a device for labelling individual packages 1, wherein the device has a feed device 2 for transporting the package 1 in a transport direction X, a printing device 3 for printing a label 5, which can be removed from a material strip 4, here for example a label 5, which is removably applied to a carrier strip 4, and an application device 6 for applying the printed label 5 to the package 1. For the sake of clarity, the printing device 3 is not illustrated in FIGS. 1, 2*a*) and 2*b*).

The feed device 2 consists of two conveyor belts 2.1 and 2.2, which are embodied as endless belts and which are arranged so as to be aligned with one another in transport direction X. The two conveyor belts 2.1 and 2.2 are arranged at a distance from one another, so that a gap 7 is embodied between them. In the illustration in FIG. 1, a package 1 is transported on the right conveyor belt 2.1 in the direction of the gap 7, wherein the package 1 has not yet reached the gap. During its transport, the package 1 is stored or guided, respectively, on the upper side of the conveyor belt 2.1 is located and of the conveyor belt 2.2, wherein the two upper sides of the conveyor belts are located in a common plane here. In terms of the invention, the plane, in which the upper side of the second conveyor belt 2.2 in transport direction, is defined as the plane, along which the package 1 is transported (transport plane).

The printing device 3 is illustrated in detail in FIG. 3 to 5*a*) (first embodiment) or in FIG. 5*b*) (second embodiment), respectively. The printing device 3 prints the labels 5 at one point in time, because the labels 5 have not yet been removed (severed) from the material strip 4 or are still applied to the carrier strip 4, respectively. After printing, the labels 5 are dispensed in a dispensing direction S by a label dispensing unit 3.1, as shown in FIG. 4, wherein the dispensing direction S has at least one direction component opposite the transport direction X of the package 1 in the case of the embodiment illustrated in FIGS. 1 to 5*a*) (in the case of the embodiment illustrated in FIG. 5*b*), the dispensing direction S has at least one direction component in transport direction X of the package 1). Preferably, the dispensing direction S also has a direction component in vertical direction, either from top to bottom (first embodiment, FIG. 1-5*a*)) or from bottom to top (second embodiment, FIG. 5*b*)), that is parallel to the direction of the force of gravity.

In particular in the case that the labels 5 are removably applied (adhered) to a carrier strip 4, the label dispensing unit 3.1. has a label dispensing edge 3.11, at which the carrier strip 4 is diverted to such an extent that the relatively stiff label 5 detaches from the carrier strip 4 at that location and is moved further in the dispensing direction S, while the carrier strip 4 is diverted/moved in a different direction, in FIG. 4 for example upwards in vertical direction (opposite the direction of the force of gravity).

As stated, the case that the labels 5 are not applied to a carrier strip 4, but are obtained by severing a partial section, which forms the respective label 5, from a material strip 4, is also possible. For this purpose, the label dispensing unit 3.1 can have a severing device (not illustrated), comprising severing means, in particular comprising a cutting wire, a blade or a knife, by means of which said partial section is severed from the other material strip so as to form the label.

After dispensing or already during dispensing from the label dispensing unit 3.1, respectively, the printed label 5 is transferred to a manipulator means 6.1 of the application device 6 or comes in contact therewith, respectively, which will be explained in more detail below.

The application device 6 has a manipulator means 6.1 for moving the printed label 5 from a pick-up position I (inside the device), in which the printed label is transferred from the label dispensing unit 3.1 to the manipulator means 6.1 in the dispensing direction S, to a dispensing position II (inside the device), in which the manipulator means 6.1 can apply the printed label 5 to the package 1. For the exemplary embodiments in FIGS. 1 and 2, the pick-up position I can be seen in the right half of the picture and the dispensing position II can be seen in the left half of the picture in FIG. 3. These positions I and II are defined as areas or locations, respectively, inside the device, at which the label transfer to the element 6.11 (pick-up position) takes place in one case and at which the label transfer to the package 1 (dispensing position) takes place in the other case.

As shown in FIG. 1, the manipulator means 6.1 has an element 6.11, which can carry out a circulating movement, wherein, in the case at hand, the element 6.11 is embodied as endless belt 6.11 in the form of a plurality of parallel aprons, which are spaced apart from one another (strictly speaking, provision is made in the case of the exemplary embodiment at hand for six such aprons, which, together, form the endless belt or element 6.11, respectively). In a first position A of the manipulator means 6.1, the endless belt 6.11 leads past the label dispensing unit 3.1 and past the feed device 2 relative to the feed device 2 and printing device 3, which is illustrated in FIGS. 2*a*), 2*b*), 3, 4, 5*a*) and 5*b*).

According to the first embodiment (FIGS. 1 to 5*a*)), the endless belt 6.11 thereby leads past the feed device 2 and label dispensing unit 3.1 so closely and/or is oriented to the feed device 2 and the label dispensing unit 3.1 in such a manner that the printed label 5 can be transferred from the label dispensing unit 3.1 to the endless belt 6.11 in the dispensing direction S at the pick-up position I and a further label 5, which was already transferred to the endless belt 6.11 beforehand, can simultaneously be applied to the package 1 at the dispensing position II. FIGS. 2) and 2*b*) show two alternatives for applying the respective label 5 to the package 1 in the first position A of the manipulator means 6.1, wherein in FIG. 2*a*), the label 5 is only applied to the package 1, when the package 1 is already located above the entire gap 7, whereas, according to FIG. 2*b*), the label 5 to be applied protrudes upwards through the gap 7 beyond the transport plane, while the package 1 has crossed the gap 7 at least only partially at that point in time.

According to the first embodiment of the device according to the invention, as is shown by FIGS. 2*a*) and 2*b*), in the first position A the manipulator means 6.1 is oriented to the feed device 2 in such a manner that, at the transfer position II, the label 5 can protrude into an area, through which the package 1 passes in response to the transport—the label 5 thus protrudes vertically beyond the transport plane from the location, at which it adheres to the element or endless belt 6.11, respectively. As is shown in FIG. 1, the manipulator means 6.1, however, can also be pivoted into a second position, in which the label 5, which adheres to the element or endless belt 6.11, respectively, does not protrude beyond said plane. The label 5 then does not protrude into the area, through which the package 1 passes in response to the transport.

As can be seen when comparing FIG. 1 to one of FIGS. 2*a*) and 2*b*), the manipulator means 6.1 can be pivoted about an axis 6.2 between the first position A (FIGS. 2*a*) and 2*b*)) and the second position B (FIG. 1), namely for example about a pivot angle α of 15° (on principle, smaller pivot angles, for example of 5°, are also possible), which ensures that a label 5, which adheres to the element or endless belt 6.11, respectively, cannot already come into contact with the package 1, when the latter is not yet in the position above the gap 7, which is provided for labelling (this applies for the first as well as the second embodiment of the device). In the case of the first embodiment, the pivoting from the first position A into the second position B also ensures that the label 5 does not come into contact with parts of the labelling device, in particular the feed device, when being transported from the pick-up position I to the dispensing position II. As can be seen clearly, in the second position B, the area of the manipulator means 6.1 or of the element 6.11, respectively, to which the printed label 5 adheres, has a larger distance from the feed device, in particular from the gap 7, than in the first position A in the case of the first embodiment; in the case of the second embodiment, this is reversed, that is, in the first position A, the area of the manipulator means 6.1 or of the element 6.11, respectively, to which the printed label 5 adheres, has a larger distance from the feed device, in particular from the gap 7, than in the second position B.

As already suggested above, the manipulator means 6.1 is configured in such a manner that the label 5 can adhere to the element or endless belt 6.11, respectively. For this purpose, the manipulator means 6.1 has a means, which is not illustrated in detail here, for generating a underpressure, for example a suction device, which suctions the label 5 and thus presses it against the element or endless belt 6.11, respectively—the label 5 adheres automatically.

As is shown in FIGS. 3 and 4, a plate 6.12, which can either be perforated (provided with bores 6.121) or slotted (provided with sots 6.122), as shown in detail x in FIG. 3, is arranged below the area of the element or endless belt 6.11, respectively, which extends from the pick-up position I to the dispensing position II (including the pick-up position I and the dispensing position II). The detail x shows an example of the perforated alternative in the illustration on the left and an example of the slotted alternative in the illustration on the right. It can be seen clearly that the endless belt 6.11, which can rest against the plate 6.12, at least in the entire area from the pick-up position I to the dispensing position II (including the pick-up position I and the dispensing position II), is arranged relative to the plate 6.12 in such a manner that the bores 6.121 or slots 6.122, respectively, end in the space between the individual aprons of the endless belt 6.11, whereby an optimal suction effect is attained, when suctioning occurs from the rear side of the plate 6.12, which faces away from the endless belt 6.11.

As is furthermore shown in FIGS. 3 and 4, the endless belt 6.11 as well as the plate 6.12 has a straight, that is, a flat course, at least in the area, which, in the case of the first embodiment, extends from the pick-up position I to the dispensing position II (including the pick-up position I and the dispensing position II). Said area of the endless belt 6.11 or of the plate 6.12, respectively, thereby runs at right angles to the transport direction X in each case and in a direction parallel to the transport plane. Said area of the endless belt 6.11 and of the plate 6.12 also runs in a direction parallel to the gap 7, which is provided between the conveyor belts 2.1 and 2.2. Here (in the case of the first embodiment in position A, in the case of the second embodiment in position B), the surface of the endless belt 6.11, to which the label 5 can adhere, runs at an angle β of 45°, for example (on principle, smaller values are also possible for this angle, for example 20°, or larger values, for example 60°), to the transport plane. In the case of the first embodiment, the printed label 5, is also dispensed from the label dispensing unit 3.1, as shown in FIG. 4; the dispensing direction S thus also runs parallel to the surface of the endless belt 6.11 in the first position A.

The element or endless belt 6.11, respectively, is connected to a clocked drive, which is not illustrated in detail here, which effects the circulating movement of the element 6.11. The stroke length (interval length), which the drive provides, corresponds to the horizontal distance between the pick-up position I and the dispensing position II. When the endless belt 6.11 is stopped, the printed label 5 can thus be dispensed from the label dispensing unit 3.1, whereby is adheres to the endless belt 6.11 in the pick-up position I. In the case of the first embodiment, the manipulator means 6.1 can subsequently be pivoted into the second position B, which is illustrated in FIG. 1, wherein a movement stroke (interval) is already carried out during the pivoting and/or after the pivoting, so that the printed label 5 is brought into a position, which corresponds to the dispensing position II in the first position A. In other words, the manipulator means 6.1 is pivoted from the second position B back into the first position A after completing the stroke (interval), the printed label 5 reaches the dispensing position II, in which the label 5 either comes into direct contact with the package 1 (FIG. 2*a*)) or protrudes into the area, which the package 1 passes in transport direction X (FIG. 2*b*)), in the case of the first embodiment.

To be able to carry out the motion sequences, which are described above and which are illustrated in FIG. 5*a*), the device, in the case of the first embodiment, has a control device, which is not illustrated in detail here, which controls the pivot movement of the manipulator means 6.1 and the circulating movement of the element or endless belt 6.11, respectively, in such a manner that the circulating movement of the element 6.11 is stopped (the label 5 is located in the pick-up position I or is dispensed into the pick-up position, respectively; the manipulator means 6.1 is located in position A), so as to transfer the label 5 from the label dispensing unit 3.1 to the element 6.11, the manipulator means 6.1 is pivoted from the first position A into the second position B (the label 5 is then located in the first transport position T), after the label 5 has been transferred to the element 6.11, the circulating movement of the element 6.11 is carried out for the duration of a stroke (interval), wherein the stroke length (interval length) of the movement corresponds to the horizontal distance between pick-up position I and dispensing position II (the label 5 is now located in the second transport position T'), in the second position B of the manipulator means 6.11, and the manipulator means 6.1 is pivoted from the second position B into the first position A (the label 5 is now located in the dispensing position II), after the circulating movement has been stopped after carrying out the stroke (interval).

As mentioned above, an alternative second embodiment is also possible in addition to the above-described first embodiment of the device according to the invention, which is illustrated in FIGS. 3, 4 and 5*a*), in the case of which each label carries out a movement, which differs as compared to the first embodiment, between the pick-up position I and the dispensing position II, or is moved along a different path (FIG. 5*b*)), respectively.

In the case of this alternative second embodiment, the device has a control device, which is not illustrated in detail here, which controls the pivot movement of the manipulator means 6.2 and the circulating movement of the element or endless belt 6.11, respectively, in such a manner that the circulating movement of the element 6.11 is stopped (the label 5 is located in the pick-up position I; the manipulator means 6.1 is located in position A), when the element 5 is transferred from the label dispensing unit 3.1 to the element 6.11, the manipulator means 6.1 is pivoted from the first position A into the second position B (the label 5 is then located in the first transport position T), after the label 5 has been transferred to the element 6.11, the manipulator means 6.1 is pivoted back into the first position A after the second position B has been reached, wherein the circulating movement of the element 6.11 is carried out for the duration of a stroke (interval), wherein the stroke length (interval length) of the movement corresponds to the horizontal distance between pick-up position I and dispensing position II (the label 5 is then located in the second transport position T'), and the manipulator means 6.1 is then moved from the first position A into the second position B (the label 5 is now in the dispensing position II).

As can be seen when comparing FIGS. 5*a*) and 5*b*), the first position A of the manipulator means 6.1 is always defined as the position, which is located closest to the printing device 3 or the label dispensing unit 3.1, respectively. In the case of the embodiments in FIGS. 5*a*) and 5*b*), the first position A and the second position B are in each case exchanged in vertical direction, that is, in the case of the embodiment in FIG. 5*a*), the first position A is that position, which is located closest to the feed device 2, whereas the second position B in FIG. 5*b*) is the position, which is located closest to the feed device 2.

A method for labeling individual packages 1 can be carried out by means of the device described above by means of FIGS. 1 to 5*b*), in which a package 1 is transported in a transport direction X, in which a label 5, which can be removed from a material strip 4 and which is in particular movably attached to a carrier strip 4, is printed, in which the printed label 5 is transferred to a manipulator means 6.1 at a pick-up position I, in which the manipulator means 6.1 moves the label 5 from the pick-up position I into a transfer position II via at least one transport position T and T' and in which the manipulator means 6.1 applies the label 5 to the package 1 at the dispensing position II, wherein the manipulator means 6.1 applies the label 5 to the package 1 at the dispensing position II, while a further printed label 5 is simultaneously arranged on the manipulator means 6.1 in the pick-up position I or in one of the transport positions T.

As stated, the manipulator means 6.1 is pivoted from a first position A into a second position after the respective label 5 has been transferred to the manipulator means 6.1 and in particular to the endless belt 6.11 at the pick-up position I, the label 5 is then moved across a distance, which corresponds to the horizontal distance between the pick-up position I and the dispensing position II, the manipulator means 6.1 is then pivoted from the second position B back into the first position A and the label 5 is finally applied to the package 1. In this case, provision is made for a further label 5 to be transferred to the manipulator means 6.1 at the pick-up position I after the manipulator means 6.1 has been pivoted from the second position B back into the first position A.

In the case of FIG. 5*b*), provision is made as an alternative for the manipulator means 6.1 to be pivoted from a first position A into a second position B after the respective label 5 has been transferred to the manipulator means 6.1 at the pick-up position I, for the label 5 to be moved across a distance, which corresponds to the horizontal distance between the pick-up position I and the dispensing position II, wherein the movement of the label 5 is carried out prior to, during and/or after pivoting the manipulator means 6.1 back from the second position B into the first position A, for the manipulator means 6.1 to then be pivoted from the first position A into the second position B and for the label 5 to then be applied to the package, wherein provision is made in particular for a further label 5 to be transferred to the manipulator means 6.1 at the pick-up position I after pivoting the manipulator means 6.1 from the second position B back into the first position A.

The invention claimed is:

1. A device for labeling individual packages comprising:

a feed device for transporting the respective package in a transport direction;

a printing device for printing a label, which can be removed from a material strip, wherein the printing device has a label dispensing unit for dispensing the printed label in a dispensing direction; and an application device for applying the printed label to the respective package, wherein the application device has a manipulator means for moving the printed label from a pick-up position, in which the printed label can be transferred from the label dispensing unit to the manipulator means in the dispensing direction, to a dispensing position, in which the manipulator means can apply the printed label to the package, via at least one transport position;

wherein the manipulator means has an element, which can carry out a circulating movement along a circulating path, wherein the element has at least a first section for picking up a printed label and at least a second section for picking up a printed label, wherein the first section and the second section are arranged on the circulating path of the element, and wherein the element has a straight course and runs at right angles to the transport direction, in the area between the pick-up position and the dispensing position or in the area between the pick-up position and the transport position, which is located in the same vertical plane as the dispensing position.

2. The device according to claim 1, wherein the first section and the second section can be brought into the pick-up position, into each transport position and into the dispensing position by moving at least one of the element and the manipulator means.

3. The device according to claim 1, wherein the manipulator means can be pivoted about an axis between a first position and a second position.

4. The device according to claim 3, wherein, in the first position of the manipulator means, the element leads past the label dispensing unit and past the feed device relative to the feed device and the printing device in such a manner that, at the pick-up position, a printed label can be transferred from the label dispensing unit to the element in the dispensing direction and that a label, which was transferred to the element, can simultaneously be applied to the package at the dispensing position.

5. The device according to claim 4, wherein, in the first position, the manipulator means is oriented to the feed device in such a manner that, at the dispensing position, the label can protrude into an area, through which the package passes during the transport.

6. The device according to claim 3, wherein, in the first position of the manipulator means, the element leads past the label dispensing unit and past the feed device relative to the feed device and the printing device in such a manner that, at the pick-up position, a printed label can be transferred from the label dispensing unit to the element in the dispensing direction and that a label, which was transferred to the element, can simultaneously be connected to the element at a transport position.

7. The device according to claim 6, wherein, in the second position, the manipulator means is oriented to the feed device in such a manner that, at the dispensing position, the label can protrude into an area, through which the package passes during the transport.

8. The device according to claim 1, wherein the manipulator means is configured in such a manner that the label can adhere to the element.

9. The device according to claim 1, wherein the manipulator means has one of a means for generating an underpressure and a means for generating an electrostatic charge.

10. The device according to claim 1, wherein the element, which can carry out the circulating movement, is an endless belt.

11. The device according to claim 10, wherein the endless belt consists of one of at least two parallel aprons and at least two parallel apron sections.

12. The device according to claim 10, wherein the manipulator means has one of a perforated plate and a slotted plate, which extends at least from the pick-up position, at which the respective label can be transferred to the manipulator means, to one of the dispensing position, at which the respective label can be applied to the package, and a transport position, which is located in the same vertical plane as the dispensing position, wherein the endless belt rests against the plate at least in a section.

13. The device according to claim 1, wherein the feed device has two conveyor belts, which can be moved in the transport direction and which are arranged to one another such that the respective package can move from the one conveyor belt to the other conveyor belt, wherein the conveyor belts are arranged so as to be aligned with one another, wherein provision is made between the conveyor belts for a gap, which runs at right angles to the transport direction and through which the manipulator means can apply the printed label to the package.

14. The device according to claim 12, wherein the plate has a straight course and runs in particular at right angles to the transport direction, in one of the area between the pick-up position and the dispensing position and the area between the pick-up position and the transport position, which is located in the same vertical plane as the dispensing position.

15. The device according to claim 3, wherein the axis runs at right angles to the transport direction and in a direction parallel to the plane, along which the package is transported.

16. The device according to claim 3, wherein the pivot angle $\alpha$ between the first position and the second position is between 5 and 60°.

17. The device according to claim 3, wherein, in the second position, the element has a larger distance from the feed device than in the first position.

18. The device according to claim 3, wherein, in the second position, a printed label, which has been transferred to the element, can be moved, without thereby protruding into the area, through which the package passes in response to the transport.

19. The device according to claim 3, wherein, in the first position, the element has a larger distance from the feed device than in the second position.

20. The device according to claim 3, wherein, in at least one of the first position and a position between the first and second position, a printed label, which is transferred to the element, can be moved without thereby protruding into the area, through which the package passes in response to the transport.

21. The device according to claim 1, wherein, in the position of the manipulator means, which is located closest to the feed device, the surface of the element, to which the label can adhere, runs at an angle to the plane, along which the package is transported.

22. The device according to claim 1, wherein the dispensing direction runs parallel to the surface of the element in the first position.

23. The device according to claim 1, wherein the element is connected to a clocked drive, which effects the circulating movement of the element, wherein the stroke length (interval length) of the movement corresponds to the horizontal distance between pick-up position and dispensing position.

24. The device according to claim 3, wherein the device has a control device, which is configured in such a manner that it can control the pivot movement of the manipulator means and the circulating movement of the element in such a manner that:

the circulating movement of the element is stopped when the label is transferred from the label dispensing unit to the element;

the manipulator means is pivoted from the first position into the second position after the label has been transferred to the element;

in the second position of the manipulator means, the circulating movement of the element is carried out for the length of a stroke (interval), wherein the stroke length (interval length) of the movement corresponds to the horizontal distance between pick-up position and dispensing position; and the manipulator means is pivoted from the second position into the first position after the circulating movement has been stopped after carrying out the stroke (interval).

25. The device according to claim 3, wherein the device has a control device, which is configured in such a manner that it can control the pivot movement of the manipulator means and the circulating movement of the element in such a manner that:

the circulating movement of the element is stopped when the label is transferred from the label dispensing unit to the element;

the manipulator means is pivoted from the first position into the second position after the label has been transferred to the element; and the manipulator means is pivoted back into the first position after the second position has been reached;

wherein the circulating movement of the element is carried out for the length of a stroke (interval), wherein the stroke length (interval length) of the movement corresponds to the horizontal distance between pick-up position and dispensing position.

26. A method for labeling individual packages comprising:

transporting a package in a transport direction;

printing a label that can be removed from a material strip;

transferring the printed label to an element of a manipulator means at a pick-up position, wherein the element has at least a first section for picking up a printed label and at least a second section for picking up a printed label, wherein at the pick-up position the label is transferred to the second section of the element;

moving, via the manipulator means, the label from the pick-up position into a transfer position via at least one transport position, wherein the element carries out a circulating movement along a circulating path, wherein the first section and the second section are arranged on the circulating path of the element; and applying, via the element of the manipulator means, the label to the package at the dispensing position, while a further printed label is simultaneously arranged on the manipulator means in one of the pick-up position and one of the transport positions;

wherein the respective label is moved at right angles to the transport direction by the element, which has a straight course and runs at right angles to the transport direction in the area between the pick-up position and the dispensing position or in the area between the pick-up position and the transport position, which is located in the same vertical plane as the dispensing position.

27. The method according to claim 26, wherein the manipulator means is pivoted from a first position into a second position after the respective label has been transferred to the manipulator means at the pick-up position, the label is then moved across a distance, which corresponds to the horizontal distance between the pick-up position and the dispensing position, the manipulator means is then pivoted from the second position back into the first position and the label is then applied to the package.

28. The method according to claim 26, wherein the manipulator means is pivoted from a first position into a second position after the respective label has been transferred to the manipulator means at the pick-up position, the label is then moved across a distance, which corresponds to the horizontal distance between the pick-up position and the dispensing position, wherein the manipulator means is then pivoted from the first position into the second position, and the label is then applied to the package.

* * * * *